US007628304B2

(12) United States Patent
Yamamoto et al.

(10) Patent No.: US 7,628,304 B2
(45) Date of Patent: Dec. 8, 2009

(54) NAIL GUIDING APPARATUS OF NAILING MACHINE

(75) Inventors: Hiroki Yamamoto, Tokyo (JP); Michiaki Adachi, Tokyo (JP); Tatsushi Ogawa, Tokyo (JP)

(73) Assignee: Max Co., Ltd., Tokyo (JP)

( * ) Notice: Subject to any disclaimer, the term of this patent is extended or adjusted under 35 U.S.C. 154(b) by 69 days.

(21) Appl. No.: 11/587,951

(22) PCT Filed: Apr. 8, 2005

(86) PCT No.: PCT/JP2005/006921

§ 371 (c)(1),
(2), (4) Date: Oct. 25, 2007

(87) PCT Pub. No.: WO2005/105385

PCT Pub. Date: Nov. 10, 2005

(65) Prior Publication Data

US 2008/0277446 A1 Nov. 13, 2008

(30) Foreign Application Priority Data

Apr. 28, 2004 (JP) ..... 2004-134306

(51) Int. Cl.
*B25C 7/00* (2006.01)

(52) U.S. Cl. ..... 227/8; 227/119

(58) Field of Classification Search ..... 227/8, 227/120, 123, 119, 140
See application file for complete search history.

(56) References Cited

U.S. PATENT DOCUMENTS 3,260,437 A * 7/1966 Parr ..... 227/149
5,238,167 A 8/1993 Howard et al.
5,452,835 A 9/1995 Shkolnikov
5,810,239 A * 9/1998 Stich ..... 227/119
6,279,808 B1 * 8/2001 Larsen ..... 227/119
6,286,742 B1 * 9/2001 Mukoyama ..... 227/8
6,578,749 B1 * 6/2003 Shen et al. ..... 227/119
6,789,718 B2 * 9/2004 Canlas et al. ..... 227/130
6,808,101 B2 * 10/2004 Laubach et al. ..... 227/109
7,017,790 B1 * 3/2006 Peng ..... 227/119
7,255,256 B2 * 8/2007 McGee et al. ..... 227/8

FOREIGN PATENT DOCUMENTS

JP 53-32485 U 3/1978
JP 6-190745 7/1994
JP 8-52666 2/1996

* cited by examiner

*Primary Examiner*—Scott A. Smith
(74) *Attorney, Agent, or Firm*—Morgan, Lewis & Bockius LLP

(57) ABSTRACT

A nailing machine for striking a nail supplied into an injection port formed at a nose portion by a driver to strike out from inside of the injection port is provided with a nail guide member on a front side of the injection port. The nail guide member is provided with a guiding guide groove for guiding a front end portion of the nail struck out from inside of the injection port at an inner side face thereof, provided with a projected portion an outer diameter shape of which is formed in a half cut converging taper shape, and provided with a bulged portion brought into contact with a surface of a construction metal piece on an upper side of the projected portion. The nailing machine is positioned by inserting the projected portion into a nail hole formed at a construction metal piece. The bulged portion constitutes a fulcrum of rotation by which the nailing machine is inclined when the nailing machine is inclined to a front side.

10 Claims, 11 Drawing Sheets

PRIOR ART

NAIL GUIDING APPARATUS OF NAILING MACHINE

TECHNICAL FIELD

The present invention relates to a nail guiding apparatus of a nailing machine to fasten a construction metal piece or the like by guiding a fastening piece of a nail or the like into a nail hole previously formed at a fixed member of the construction metal piece or the like by striking out the nail supplied into an injection port formed at a nose portion from the injection port by way of a driver impactively driven by power of compressed air or the like.

BACKGROUND ART

In wooden construction, a construction metal piece previously formed with a number of nail holes is frequently used in connecting a column member, a beam member and a girder member or the like, or for reinforcing connecting portions of the structure members. The construction metal pieces are struck to fasten to a structure member of a column or the like by nails. In striking to fasten such a construction metal piece previously formed the nail hole, a nailing machine made to continuously strike a nail by power of compressed air or the like is used. According to the nailing machine made to strike the nail into the nail hole of the construction metal piece, the nail is struck into the nail hole by starting the nailing machine in a state of arranging the nail supplied into the injection port for slidably guiding the driver driven by power such that a tip of the nail is projected from a front end of the injection port and inserting the tip of the nail projected from the front end of the injection port into the hole of the construction metal piece.

In one mechanism for projecting the tip portion of the nail from the front end of the injection port before starting the nailing machine, connected nails connected in a skewed direction by making nail axes in parallel with each other and shifting the respective nails in an axial direction are charged into a magazine continuously provided to the nose portion forming the injection port, a tip of a front one nail supplied from the magazine into the injection port of the nose portion is projected from the front end of the injection port, the tip of the nail is inserted into the hole of the meal piece and the nail is struck by positioning the nailing machine. Further, in other mechanism, a push piston mechanism sliding along the injection port of the nose portion is provided, prior to striking the nail by the driver, the push piston mechanism cut to separate the front one of the connected nails supplied into the injection port from a connected state to press to a direction of the front end of the injection port and the tip portion of the nail is held to be projected from the front end of the injection port.

However, in the former mechanism, the front nail of the connected nails connected by way of a connecting band is projected from the injection port and the tip of the nail is inserted into the hole of the construction metal piece to thereby position the nail machine and therefore, there poses a problem that the front nail is supported by a rigidity of the connecting band of the connected nails and operation of positioning the nail machine becomes unstable. Further, according to the latter mechanism, the push piston mechanism for moving the nail supplied into the injection port to the direction of the front end of the injection port needs to be installed to the nose portion, cost is increased, further, an outer shape of the nose portion becomes large to hamper operability.

Further, according to the mechanisms, the nailing machine is guided to the nail hole of the construction metal piece by the tip of the nail projected from the injection port of the nose portion and therefore, a safety mechanism for starting the nailing machine by pressing a contact member arranged to be projected frontward from the nose portion to the struck member and by a trigger operated by the hand grabbing a grip cannot be used. Therefore, there poses a problem of needing a safety apparatus by a complicated mechanism of operating to project a contact member in the direction of the front end along the nose portion by operating the trigger after positioning the tip of the nail projected from the injection port at inside of the nail hole and starting the nailing machine when the contact member impinges on the struck member and cannot be moved to the position projected to the front end side of the nose portion.

In order to deal with the problems, according to the nailing machine disclosed in JP-A-08-052666, a nail guide member a shape of an outer peripheral face of a front end portion of which is constituted by a shape of cutting to halve a converging taper in a longitudinal direction is arranged on the front side of the detection port formed at the nose portion, and the nailing machine is positioned by inserting the front end portion of the guide member in the shape of the half cut converging taper into the nail hole of the construction metal piece. By guiding the tip of the nail struck out from the injection port along a guiding guide groove formed at a rear side face of the guide member, the nail is guided into the nail hole of the construction metal piece to be struck into the nail hole.

According to the nailing machine of JP-A-08-052666, as shown by FIG. 10, when the nail is struck by making the nail striking direction of the nail machine orthogonal to a face of a struck member, a front end portion 51 of a nail guide member 50 formed in the shape of the half cut taper is fitted to a position of substantially a half of inside of a nail hole H of a construction metal piece M. Therefore, the nail can firmly be struck into the nail hole H of the construction metal piece M by guiding the tip of the nail struck by being guided along a guiding guide groove 52 of the nail guide member 51 into the nail hole H. However, at a construction site, there is a case in which the nail striking direction of the nailing machine cannot necessarily be maintained to be orthogonal to the face of the struck member and there is a case in which the nailing machine is operated by being inclined to a front side. In this case, as shown by FIG. 11, when the nail guide member 50 is inclined to the front side, the front end portion 51 of the nail guide member 50 in the shape of the half cut taper is inclined by being slipped to a rear side at inside of the nail hole H of the construction metal piece M. The front end portion 51 of the guide member 50 impinges on an edge portion on the rear side to close the nail hole H and an axial line direction of the nail N guided by the guiding guide groove 52 is not guided into the nail hole H of the construction metal piece M.

When the nail is struck by starting the nailing machine in the inclined state in this way, the tip of the nail guided by the nail guide member 50 impinges on the surface of the construction metal piece M, the nail jumps back in an unexpected direction and therefore, the operation is extremely dangerous. Further, although since the front end portion 51 of the nail guide member 50 is formed to be thin, the front end portion 51 is easy to be destructed and needs to be interchanged frequently, in interchanging the nail guide member 50, a tool of a spanner, a screwdriver or the like is needed to pose a problem that the nail guide member 50 cannot easily be interchanged at an operation site.

DISCLOSURE OF THE INVENTION

An embodiment of the invention provides a nail guide apparatus of a nailing machine for guiding a front end of a nail struck out from inside of an injection port of a nose portion firmly into a nail hole of a construction metal piece in order to resolve the problem of the background art. Further, the embodiment provides a nailing machine capable of easily interchanging a nail guide member constituting the nail guide apparatus.

A nailing machine of an embodiment of the invention is provided with a driver operated by a drive force of compressed air or the like, a nose portion formed with an injection port in a hollow shape for slidably guiding the driver, and a nail guide member arranged on a front side in a direction of a front end of the injection port for guiding a nail member struck by the driver, the guide member includes a projected portion an outer diameter shape of which is formed in a half cut converging taper shape and which advances to an inner portion of a nail hole formed at a fixed piece member to position the nailing machine to the nail hole, a guiding guide groove formed to be able to guide a front end of the nail struck by the driver to the projected portion, and a bulged portion formed on an upper side of the projected portion and brought into contact with a surface of the fixed piece member, and when the nailing machine positioned to the nail hole is inclined to a front side, the bulged portion constitutes a fulcrum of the inclination.

Further, in an embodiment, the nail guide member is arranged between side walls opposed to each other provided on a front end side of a contact member provided movably along the nose portion and arranged to be projected from the front end of the injection port such that at least the projected portion and the bulged portion are projected and held between the opposed side walls by a pin member one end side of which is formed with a locking edge portion and other end side of which is mounted with an elastic ring-like member.

Other aspects and advantages of the invention will be apparent from the following description and the appended claims.

According to an embodiment of the invention, a nail guide member for guiding a nail member struck by the driver is provided with a projected portion an outer diameter shape of which is formed in a half cut converging taper shape and which advances into an inside of a nail hole formed at a fixed piece member to position the nailing machine to the nail hole, a guiding guide groove formed to be able to guide a front end of the nail struck by the driver to the projected portion, and a bulged portion formed on an upper side of the projected portion and brought into contact with a surface of the fixed piece member, and the bulged portion constitutes a fulcrum of inclination when the bulged portion is inclined to a front side. As a result, after the projected portion of the nail guide member is advanced into the nail hole of the fixed member to position, when the nailing machine is inclined to the front side, the nailing machine is inclined by constituting the fulcrum by the bulged portion of the nail guide member and therefore, the projected portion of the nail guide member is not moved to an end edge on a rear side of the nail hole. Therefore, a dimension of guiding the front end of the nail guided to the projected portion by the guiding guide groove of the nail guide member to inside of the nail hole can be ensured, and even when the nail is struck out in a state of inclining the nailing machine, a front end of the nail can firmly be guided to inside of the guide hole.

Further, although there is a case in which when an inner diameter of the nail hole formed at the construction metal piece differs, a depth of advancing the projected portion of the nail guide member formed in the taper shape into the guide hole is changed, as a result, a depth of striking the nail struck out from the nailing machine is varied, since the bulged portion is formed on the upper side of the projected portion in the taper shape, regardless of a size of a dimension of a diameter of the nail hole of the construction metal piece, the bulged portion is engaged with the surface of the construction metal piece, a positional relationship between the nail guide member and the surface of the construction metal piece is maintained constant and therefore, the depth of striking the nail struck out from the nailing machine can be maintained constant.

Further, according to an embodiment of the invention, the nail guide member is arranged between the side walls opposed to each other provided movably along the nose portion and arranged to be projected from the front end of the injection port such that at least the projected portion and the bulged portion are projected and held between the opposed side walls by the pin member the one end side of which is formed with the locking edge portion and the other end side of which is mounted with the elastic ring-like member. Therefore, by detaching the elastic ring-like member mounted to the end portion of the pin, the nail guide member can easily be separated from the contact member by drawing out the pin, further, the nail guide member can be attached to the contact member by inserting the pin and mounting the elastic ring-like member to an end portion of the pin in the state of arranging the nail guide member between the opposed side walls of the contact member. As a result, the operation of interchanging the nail guide member can easily be carried out without needing any tool.

BRIEF DESCRIPTION OF THE DRAWINGS

FIG. 1 is a vertical sectional side view showing a portion of a nailing machine according to an embodiment of the invention.

FIG. 2 is a front view showing a contact member and a contact arm of the nailing machine of FIG. 1.

FIG. 3 is a side view of the contact member and the contact arm the same as those of FIG. 2.

FIG. 4 is a vertical sectional side view of a contact member of the nailing machine of FIG. 1.

FIG. 5 is a sectional view taken along a line V-V of FIG. 4.

FIG. 6 is a vertical sectional side view of the contact member the same as that of FIG. 4 in a state of detaching a nail guide member.

FIG. 7 is a vertical sectional side view showing an operating state of striking a nail into a nail hole of a construction metal piece.

FIG. 8 is a vertical sectional side view showing an operating state of finishing to strike the nail into the nail hole of the construction metal piece.

FIG. 9 is a vertical sectional side view showing a state of the nail guide member inclined to a front side and the nail hole of the construction metal piece.

FIG. 10 is a vertical sectional side view showing a state of engaging with a nail hole of a construction metal piece by a nail guide member of a background art.

FIG. 11 is a vertical sectional side view showing a state of engaging the inclined nail guide member of the background art and the nail hole of the construction metal piece.

DESCRIPTION OF REFERENCE NUMERALS AND SIGNS

Figure 1:
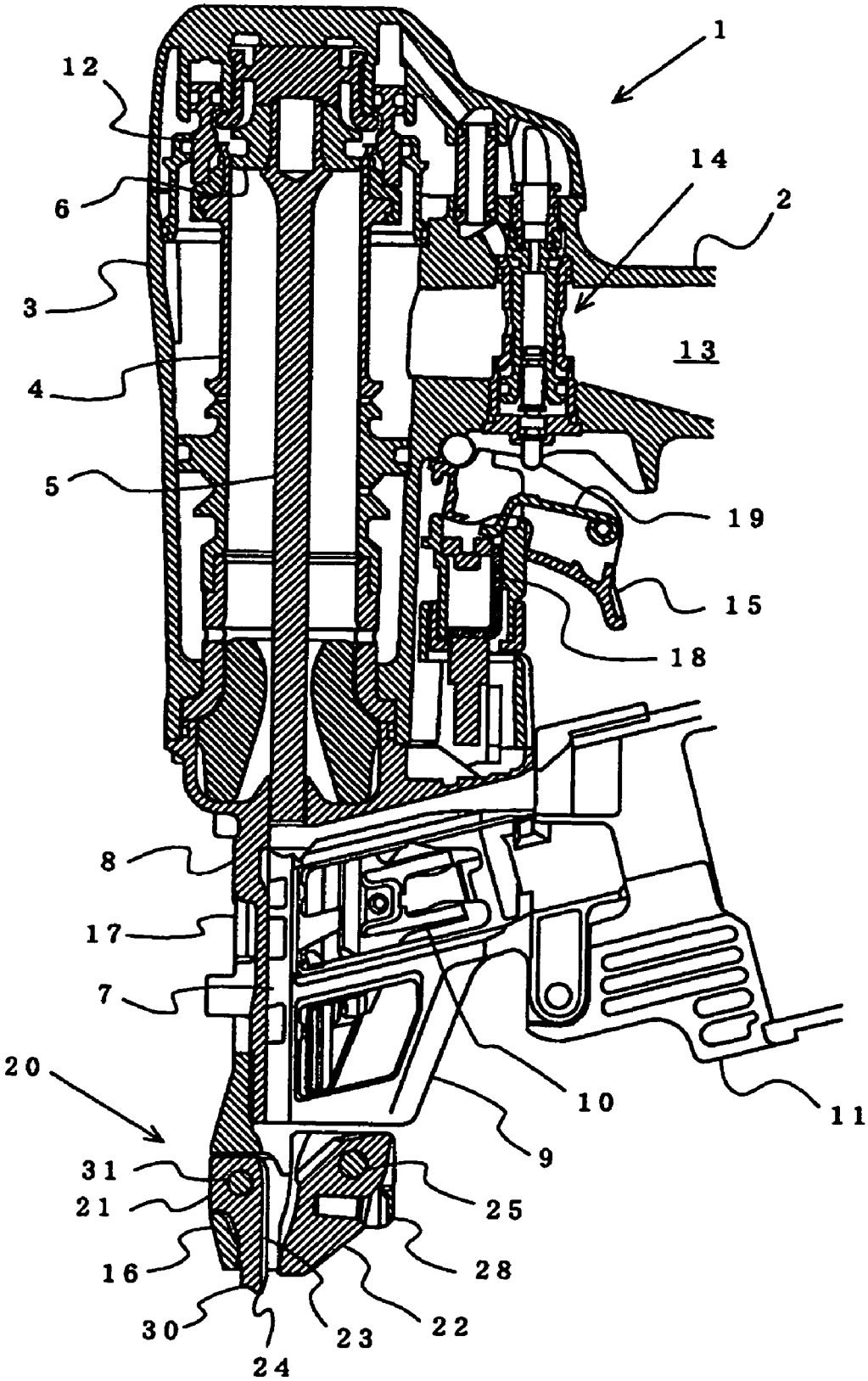
[FIG. 1]

7 injection port
8 nose portion
16 contact member
20 nail guiding apparatus
21 nail guide member
22 ratchet member
23 guiding guide groove
24 projected portion
30 bulged portion
31 fixing shaft

BEST MODE FOR CARRYING OUT THE INVENTION

Embodiments of the invention will be explained in reference to the drawings as follows.

FIG. 1 shows a nailing machine 1 having a mechanism of guiding a nail according to an embodiment of the invention. A strike cylinder 4 is arranged at inside of a housing 3 in a hollow shape integrally formed with a grip portion 2. Inside of the strike cylinder 4 is slidably contained with a strike piston 6 coupled with a driver 5 for striking a nail at a lower face thereof. A lower side of the housing 3 is attached with a nose portion 8 forming an injection port 7 for striking and guiding a nail to a struck member. The driver 5 is slidably guided at inside of the injection port 7 of the nose portion 8. A rear side of the injection port 7 of the nose portion 8 is formed with an opening for introducing a nail to inside of the injection port 7. A nail supply guide 9 is formed between one side edge of the opening and a magazine 11 containing connected nails shaft portions of which are connected to each other. The nail supply mechanism 10 is arranged along the nail supply guide 9. The connected nails contained at inside of the magazine 11 are supplied along the nail supply guide 9 by the nail supply mechanism 10. A front one nail of the connected nails is successively supplied to inside of the injection port 7 of the nose portion 8.

A main valve 12 is arranged at an upper end of the strike cylinder 4. The main valve 12 selectively connects inside of an air chamber 13 formed at an inner portion of the grip portion 2 connected to a compressed air supply source and an exhaust port at inside of the strike cylinder 4. Compressed air at inside of the air chamber 13 is introduced into the strike cylinder 4 by connecting inside of the strike cylinder 4 to the air chamber 13 by the main valve 12. The strike piston 6 is driven by the compressed air, and the driver 5 coupled to the strike piston 6 strikes a nail supplied into the injection port 7 to strike out. A root portion of the grip portion 2 is arranged with a trigger valve 14 for controlling the main valve 12. The trigger valve 14 is operated by operating a manually operable trigger lever 15 to thereby operate the main valve 12.

Figure 2:
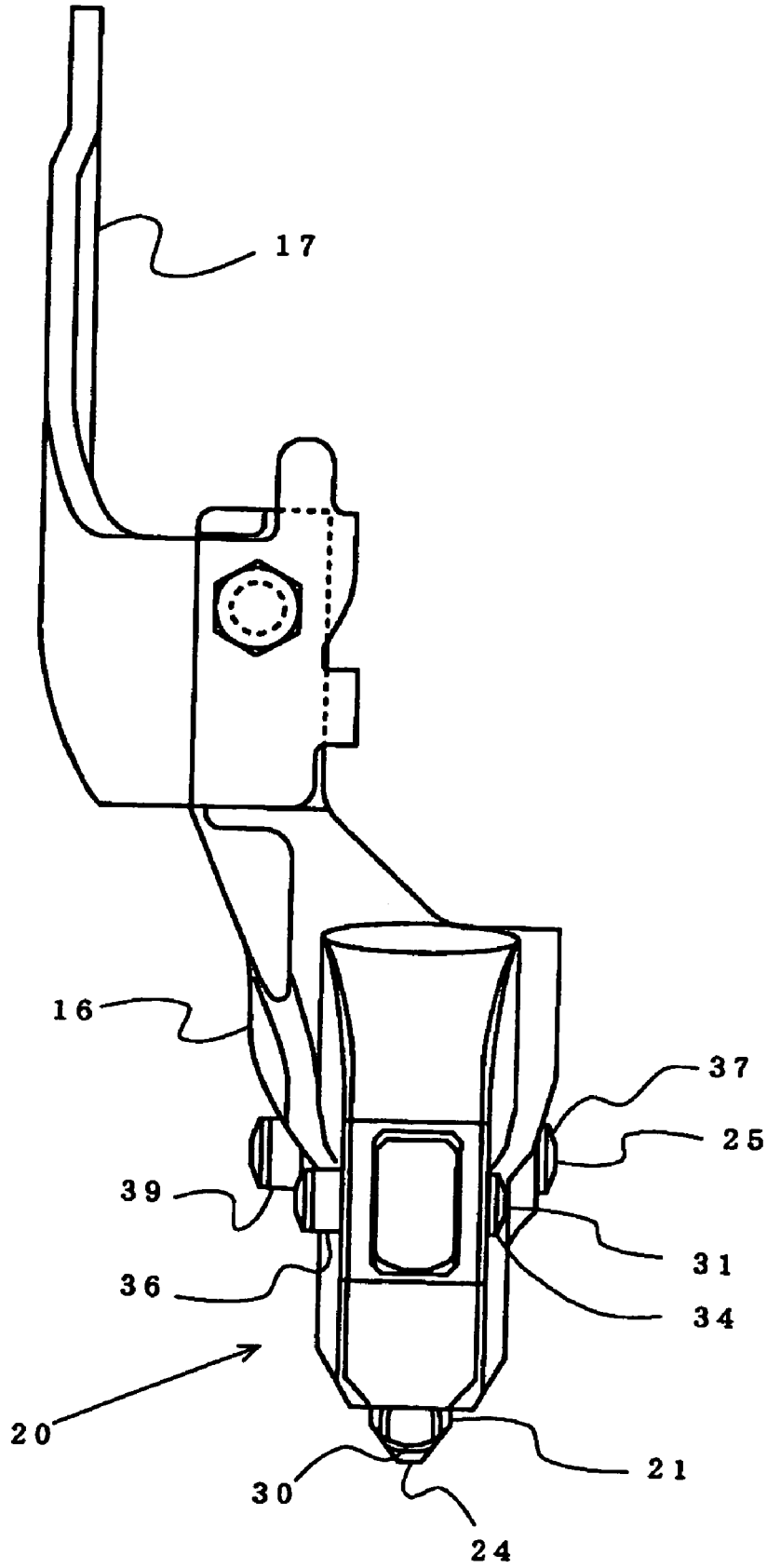
[FIG. 2]
Figure 3:
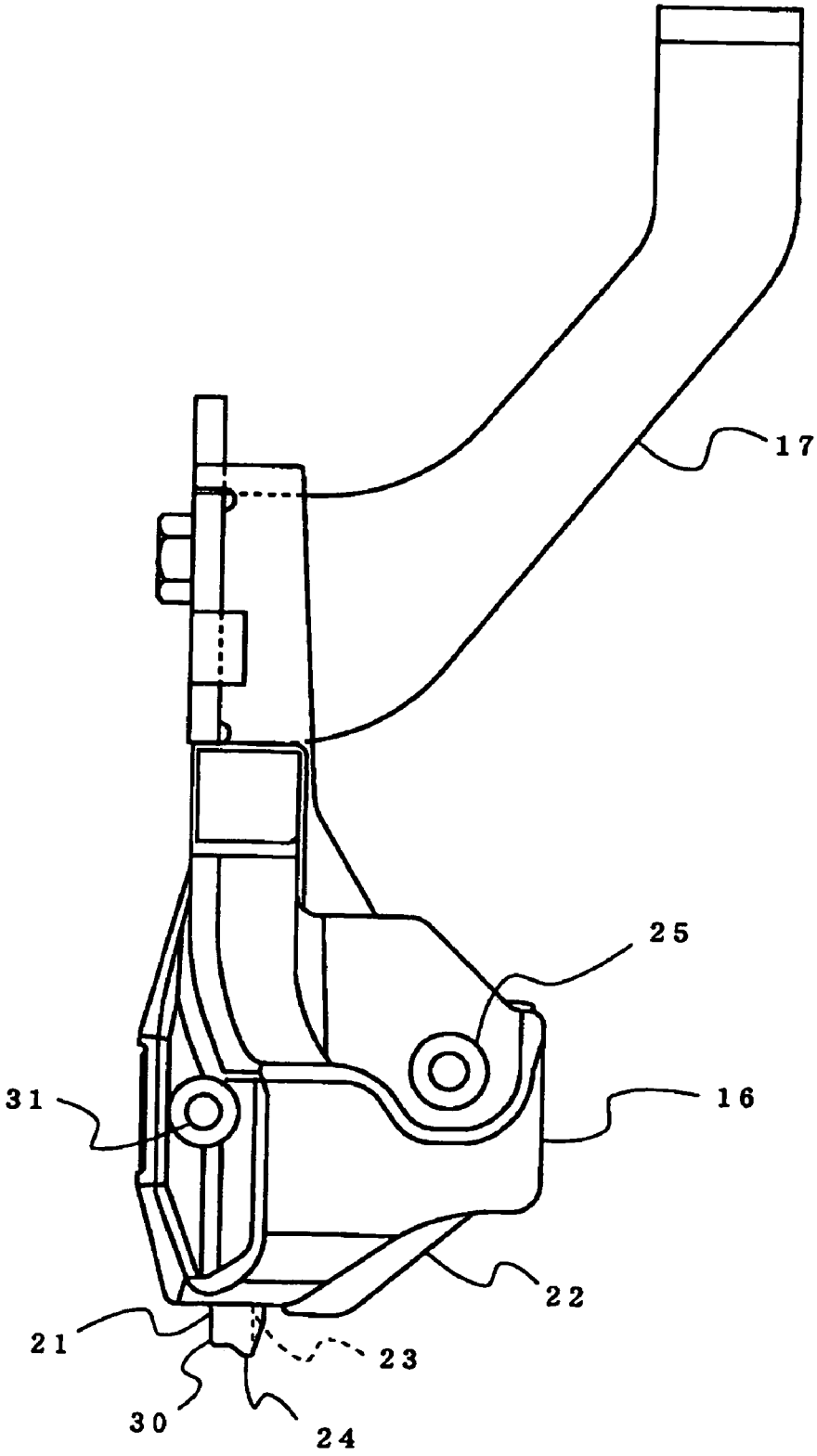
[FIG. 3]

As shown by FIG. 2 and FIG. 3, a front side in a direction of a front end of the nose portion 8 is provided with a contact member 16 arranged to be projected in the direction of the front end of the nose portion 8 to be able to be engaged with a struck member in driving the nailing machine 1 movably along the direction of extending the nose portion 8. An upper end side of the contact member 16 is connected with a contact arm 17 whose upper end portion 18 is arranged at a vicinity of a base portion of the trigger lever 15. The contact member 16 is operated by a reaction for pressing the nailing machine 1 to the struck member, an upper end portion 18 of the contact arm 17 operates to pivot a contact lever 19 axially supported by the trigger lever 15, further, by operating to pivot the trigger lever 15 by an operator, the trigger valve 14 is operated to start the nailing machine 1.

Figure 4:
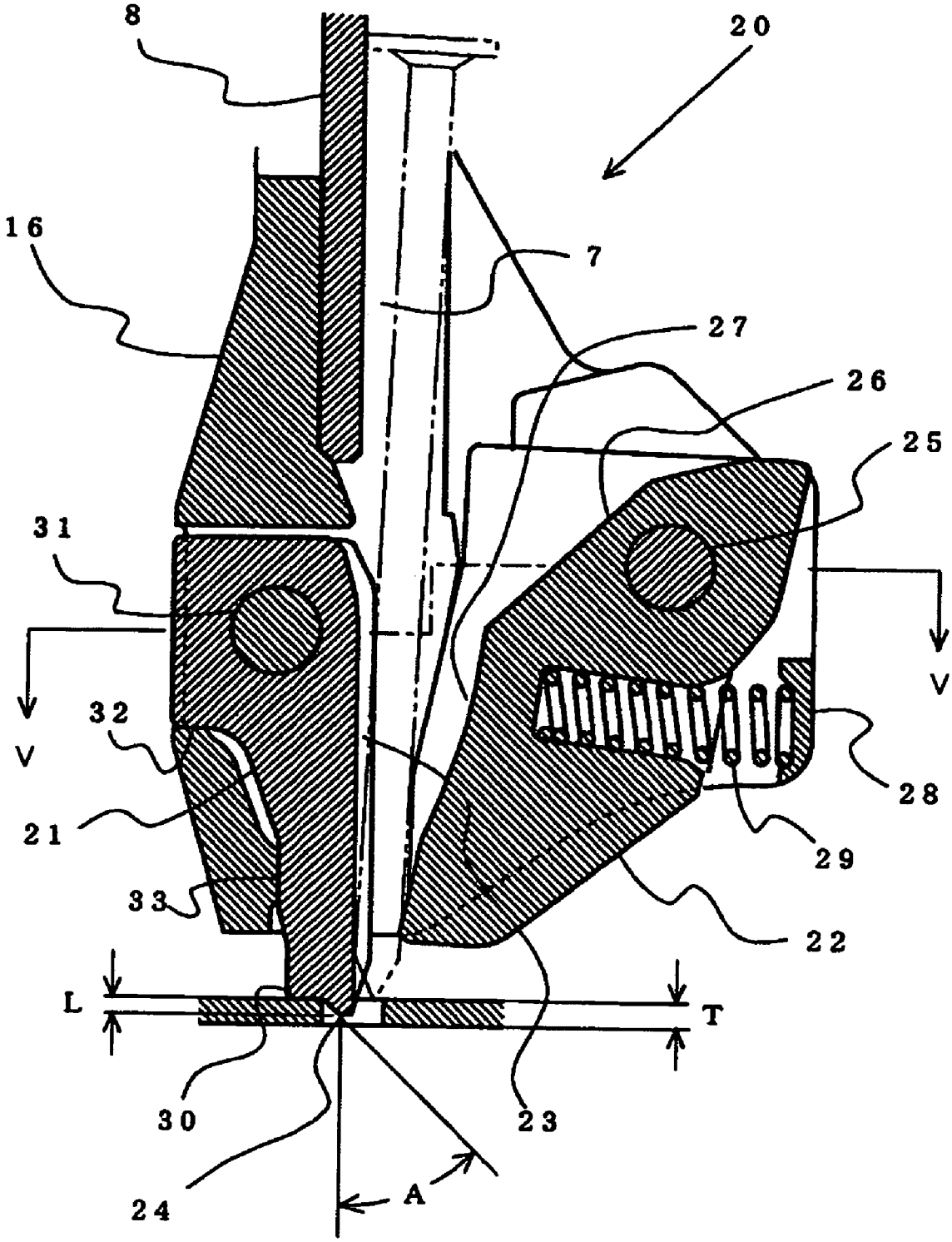
[FIG. 4]

As shown by FIG. 4, the contact member 16 is formed with a nail guide apparatus 20 for guiding a nail struck out by the driver 5 from the injection port 7 of the nose portion 8 to the struck member. The nail guide apparatus 20 is constituted by the nail guide member 21 and a ratchet member 22. The nail guide member 21 is arranged on a front side of the injection port 7 for guiding a nail struck out from the injection port 7 of the nose portion 8 in a direction of extending the injection port 7 formed at the nose portion 8. The ratchet member 22 is arranged on a rear side of the injection port 7 for preventing a nail struck out from the injection port 7 of the nose portion 8 from being struck out to a rear side of the nose portion 8 from an opening portion for supplying a nail from the magazine 11 opened on a rear side of the injection port 7.

A rear side face of the nail guide member 21 is formed with a guiding guide groove 23 for guiding a nail struck out from the injection port 7 of the nose portion 8 in a direction of extending the injection port. The nail guide member 21 is attached to the contact member 16 such that the guiding guide groove 23 is arranged coaxially with the injection port 7 of the nose portion 8. Further, a front end portion of the nail guide member 21 is formed with a projected portion 24 having an outer shape constituted by cutting to halve a converging taper shape in a longitudinal direction such that the front end portion can be inserted to a nail hole of a construction metal piece constituting an example of the struck member. The projected portion 24 of the nail guide member 21 formed in the half cut converging taper shape is arranged to be projected from a front end of the contact member 16 further in the front end direction. The projected portion 24 of the nail guide member 21 is engaged into a nail hole of the construction metal piece to position the nose portion 8 of the nailing machine. As a result, the front end of the nail struck out from the injection port 7 of the nose portion 8 is guided to the nail hole.

The ratchet member 22 is supported by the contact member 16 pivotably by a pivotably supporting shaft 25 on a rear side of the injection port 7 to be opposed to the guiding guide groove 23 of the nail guide member 21. An upper face and a front face of the ratchet member 22 are formed with an inclined face 26 brought into sliding contact with a front end of a nail struck out by being inclined to a rear side at inside of the injection port 7 of the nose portion 8 for guiding the front end portion of the nail to the front side, and a guiding face 27 formed in a shape of a conical shape for guiding the front end and the shaft portion of the nail to a center position in a width direction. Further, the ratchet member 22 is urged to pivot such that a lower end portion of the guiding face 27 becomes proximate to the guiding guide groove 23 of the nail guide member 21 by a spring 29 interposed between the ratchet member 22 and a spring receive portion 28 formed at the contact member 16. By the pivoting urge force, the shaft portion of the nail struck out from the injection port 7 of the nose portion 8 is pressed to a side of the guiding guide groove 23 of the nail guide member 21 to bring the front end portion of the nail into close contact with the guiding guide face 23.

As shown in FIG. 4 in details, a taper shape of the half cut converging taper shape formed at the projected portion 24 of the nail guide member 21 is formed such that an angle A of the taper becomes larger than 45 degrees. Thereby, the projected portion 24 inserted into the nail hole of the construction metal piece is made to be easy to escape from the nail hole in striking the nail into the nail hole. By forming the taper angle A of the projected portion 24 larger than 45 degrees, durability of the projected portion 24 in the half cut converging taper shape of the nail guide member 21 is enhanced. Further, a front side of the nail guide member 21 on an upper side of the projected portion 24 is formed with a bulged portion 30 engaged with a surface of the construction metal piece at a surrounding of the nail hole when the projected portion 24 in the converging shape is inserted into the nail hole of the construction metal piece. A position of the bulged portion 30 is set such that a length L of projecting the projected portion 24 in the converging shape from the bulged portion 30 becomes smaller than a thickness dimension T of the thinnest one of the construction metal piece constructed by the nailing machine.

According to the embodiment, whereas the thickness dimension T of the thinnest one of the construction metal piece constructed by the nailing machine 1 is 1.2 mm, a projected length of the projected portion 24 projected in the front end direction from the bulged portion 30 is set to a dimension between 0.5 mm and 1.0 mm. Thereby, even when the projected portion 24 of the nail guide member 21 is inserted into the nail hole of the thinnest one of the construction metal piece, the projected portion 24 of the nail guide member 21 is not brought into contact with a matrix member, thereby, the nose portion 8 of the nailing machine 1 can be positioned at a constant position from the surface of the construction metal piece, and it can be detected by the hand operating the nailing machine 1 that the projected portion 24 of the nail guide member 21 is fitted into the nail hole.

Figure 5:
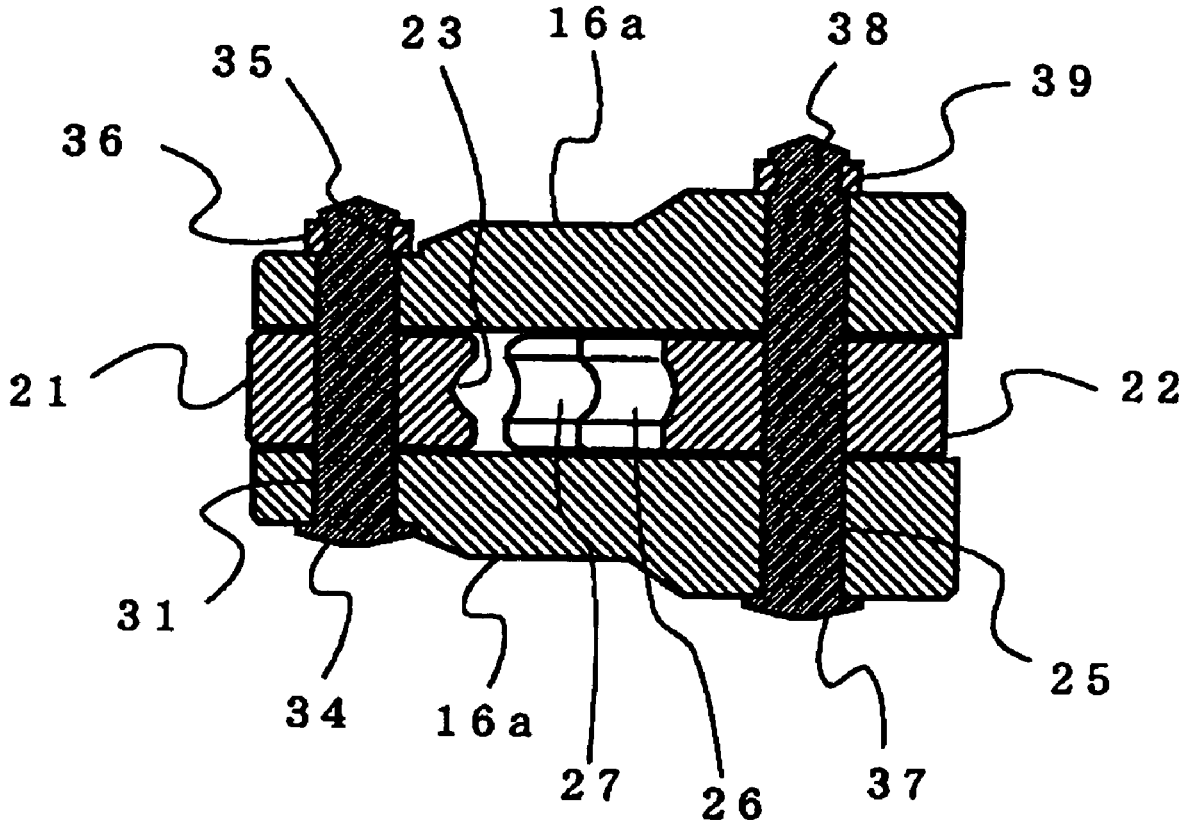
[FIG. 5]

As shown by FIG. 5, the nail guide member 21 is arranged between opposed side walls 16*a*, 16*a* constituting the contact member 16, and the nail guide member 21 is fixed to the contact member 16 by penetrating a fixing shaft 31 penetrating the nail guide member 21 through the opposed side walls 16*a*, 16*a* of the contact member 16 to be supported thereby. As shown by FIG. 4, the nail guide member 21 is fixed to the contact member 16 so as not to be pivoted or moved relative thereto by being brought into contact with contact faces 32, 33 formed on the contact member 16 in directions orthogonal to each other. As shown by FIG. 5, the fixing shaft 31 for fixing the nail guide member 21 is constituted by being formed with a head portion 34 a diameter of which is enlarged to one end side as a locking edge portion and formed with a ring-like groove 35 on the other end side, and the fixing member 31 is prevented from being drawn out by mounting an elastic ring-like member 36 to the ring-like groove 35 of the fixing shaft 31 penetrated through the nail guide member 21 and the both side walls 16*a*, 16*a* of the contact member 16.

Further, also the support shaft 25 for supporting the ratchet member 22 pivotably by the contact member 16 is constituted by being formed with a head portion 37 a diameter of which is enlarged to one end side and formed with a ring-like groove 38 on other end side similar to the fixing shaft 31, and the support shaft 25 is prevented from being drawn out by mounting an elastic ring-like member 39 to the ring-like groove 38 of the support shaft 25 penetrating the ratchet member 22, and the side walls 16*a*, 16*a* of the contact member 16 opposed to each other.

Figure 6:
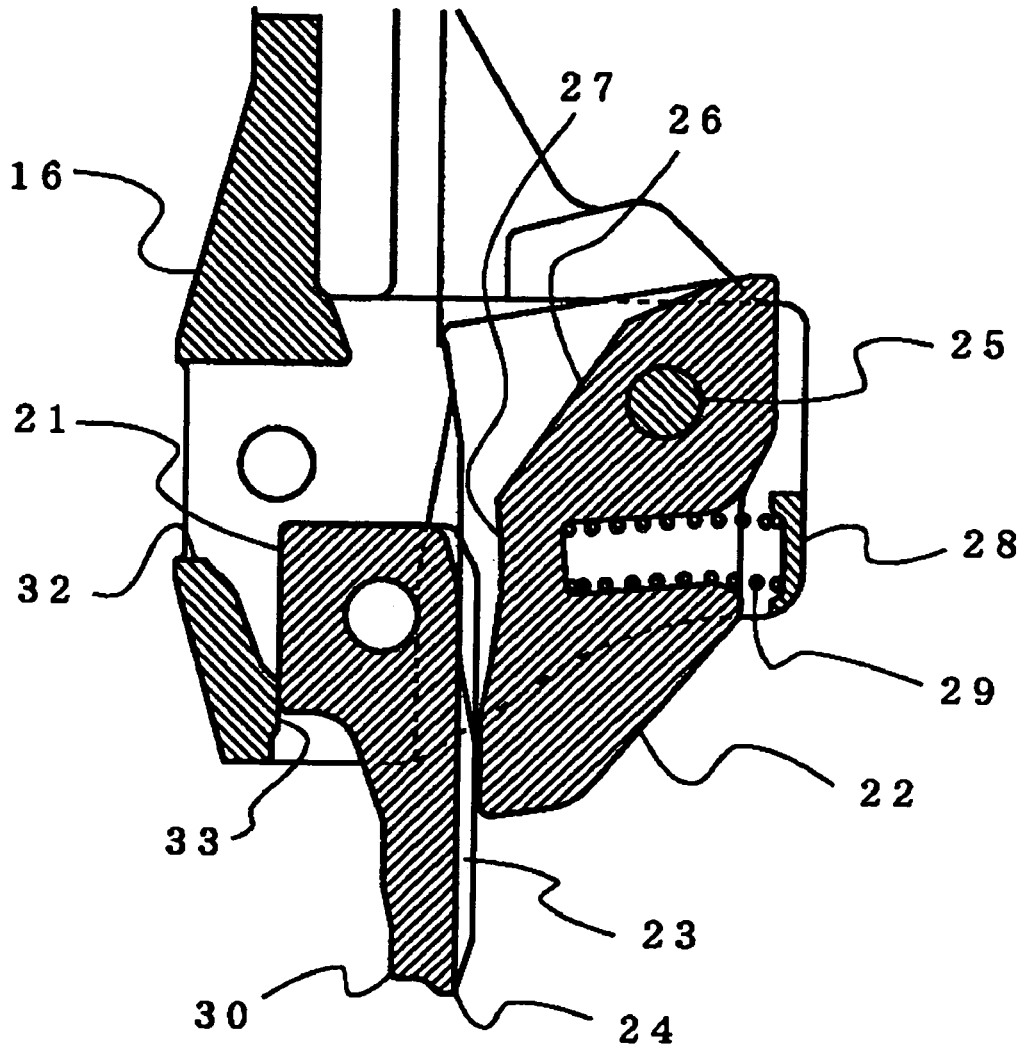
[FIG. 6]

The elastic ring-like members 36, 39 mounted to the ring-like grooves 35, 38 of the fixing shaft 31 and the supporting shaft 25 can easily be detached from the ring-like grooves 35, 38 by the fingers, the fixing shaft 31 and the support shaft 25 detaching the elastic ring-like members 36, 39 can easily be drawn from the contact member 16, thereby, the nail guide member 21 and the ratchet member 22 can be detached from the contact member 16. Further, as shown by FIG. 6, after drawing out the fixing shaft 31, the nail guide member 21 can be detached in a direction of striking out a nail relative to the contact member 16 by pivoting the ratchet member 22. Further, when the nail guide member 21 and the ratchet member 22 are integrated to the contact member 16, the nail guide member 21 and the ratchet member 22 can be integrated thereto without needing any tool by penetrating the fixing shaft 31 and the support shaft 25 through the nail guide member 21 and the ratchet member 22 arranged between the side walls 16*a*, 16*a* of the contact member 16 opposed to each other by passing the side walls 16*a*, 16*a* opposed to each other and respectively mounting the elastic ring-like members 36, 39 to the ring-like grooves 35, 38 of the both shafts 31, 25.

A state of operating the nail guide apparatus 20 of the nailing machine according to the embodiment will be explained in reference to FIG. 7 through FIG. 9 as follows. The projected portion 24 is engaged with the nail hole H of the construction metal piece M while operating to move the nailing machine 1 by bringing the projected portion 24 of the nail guide member 21 projected in the direction of the front end of the contact member 16 of the nailing machine into contact with a surface of the construction metal piece M. By operating to press to the nailing machine 1 to the construction metal piece M in a state of engaging the projected portion 24 of the nail guide member 21 into the nail hole H of the construction metal piece M, the nose portion 8 of the nailing machine 1 is positioned to the nail hole H of the construction metal piece M, thereafter, the nailing machine is started by operating the trigger lever and the nail is struck out from the injection port of the nose portion.

Figure 7:
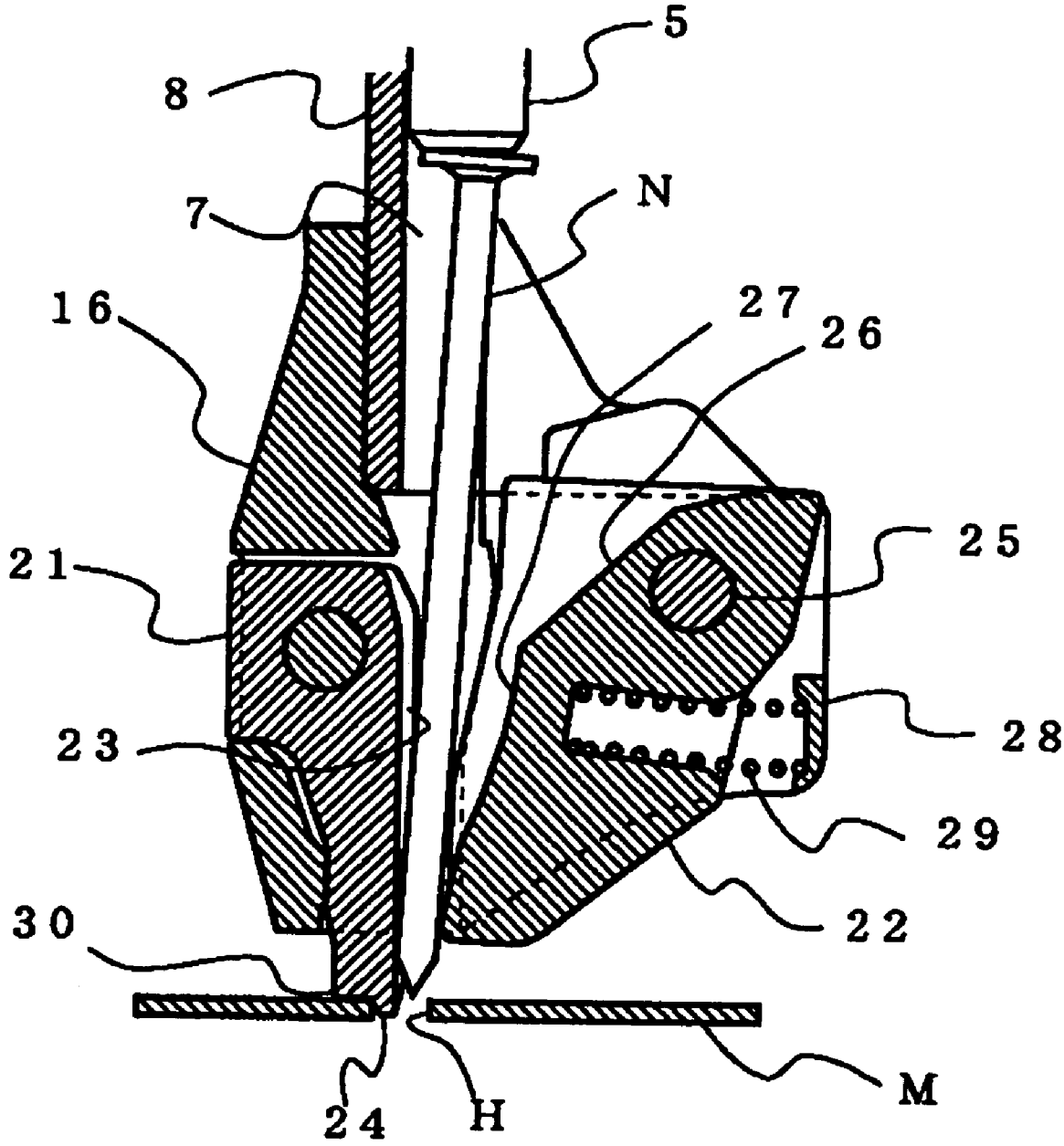
[FIG. 7]
Figure 8:
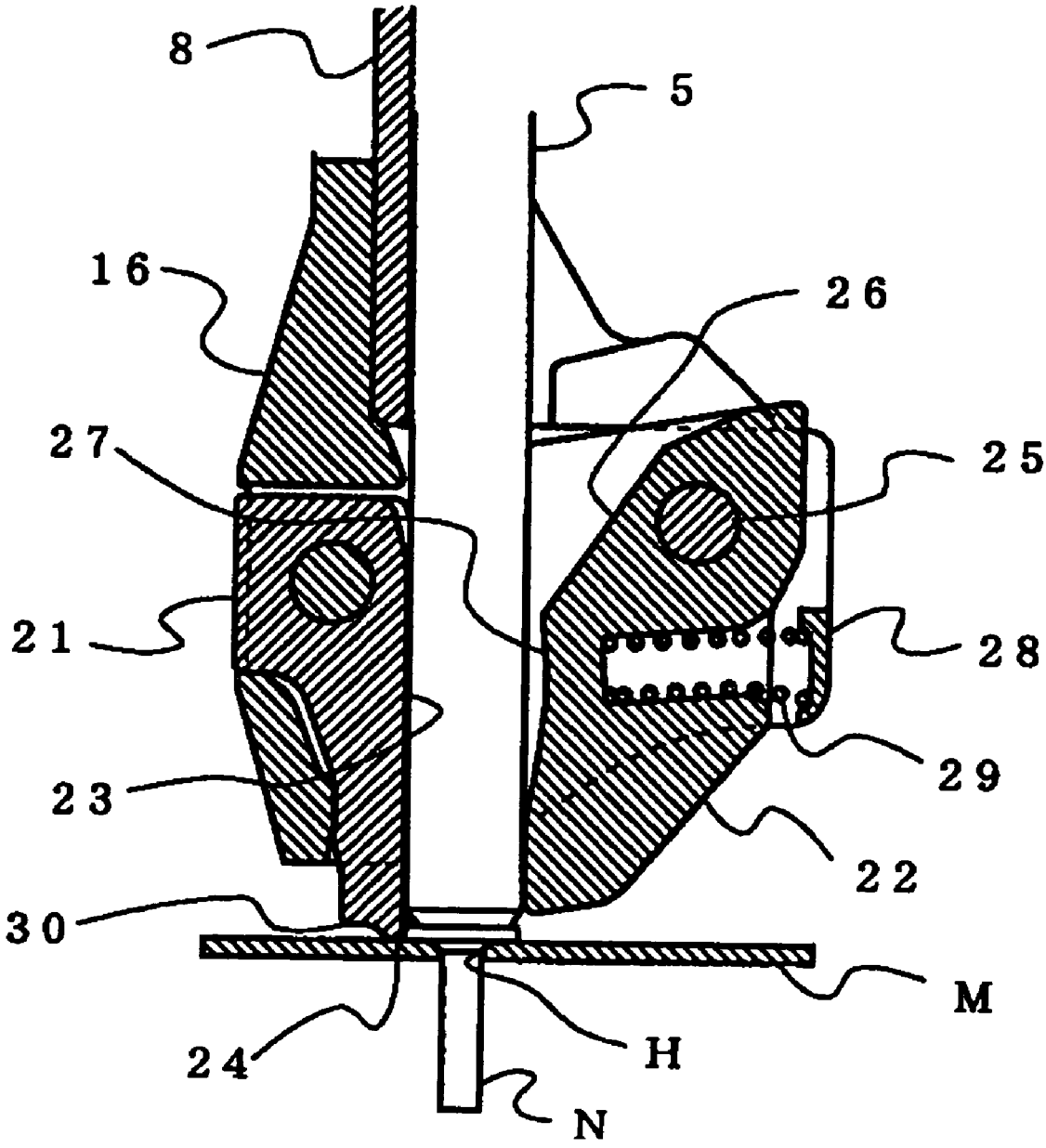
[FIG. 8]

As shown by FIG. 7, when the injection port 8 of the nose portion 8 of the nailing machine is held in a state substantially orthogonal to the construction metal piece M, the nail N struck out by the driver 5 from the injection port 7 of the nose portion 8 is guided to the front side by engaging the front end with the inclined face 26 and the guiding face 27 of the ratchet member 22, a front end of the nail N is struck along the guiding guide groove 23 of the nail guide member 21, as a result, the front end of the nail N is struck into the nail hole H by being guided to inside of the nail hole H of the construction metal piece M. In this way, in a state of positioning the nail guide member 21 substantially orthogonal to the nail hole H of the construction metal piece M, a lower face side of the bulged portion 30 formed at the nail guide member 21 is brought into contact with the surface of the construction metal piece M, and a depth of striking the nail can be maintained constant by maintaining a position of the nose portion 8 from the surface of the construction metal piece M constant. When a tip of the front end portion of the nail N is guided into the guide hole H and a nail shaft portion is penetrated into the nail hole H, the projected portion 24 of the nail guide member 21 is pressed by the struck nail N, extruded from inside of the nail hole H along the taper shape of the projected portion 24 and the nail N is struck into the nail hole H of the construction metal piece M as shown by FIG. 8.

Figure 9:
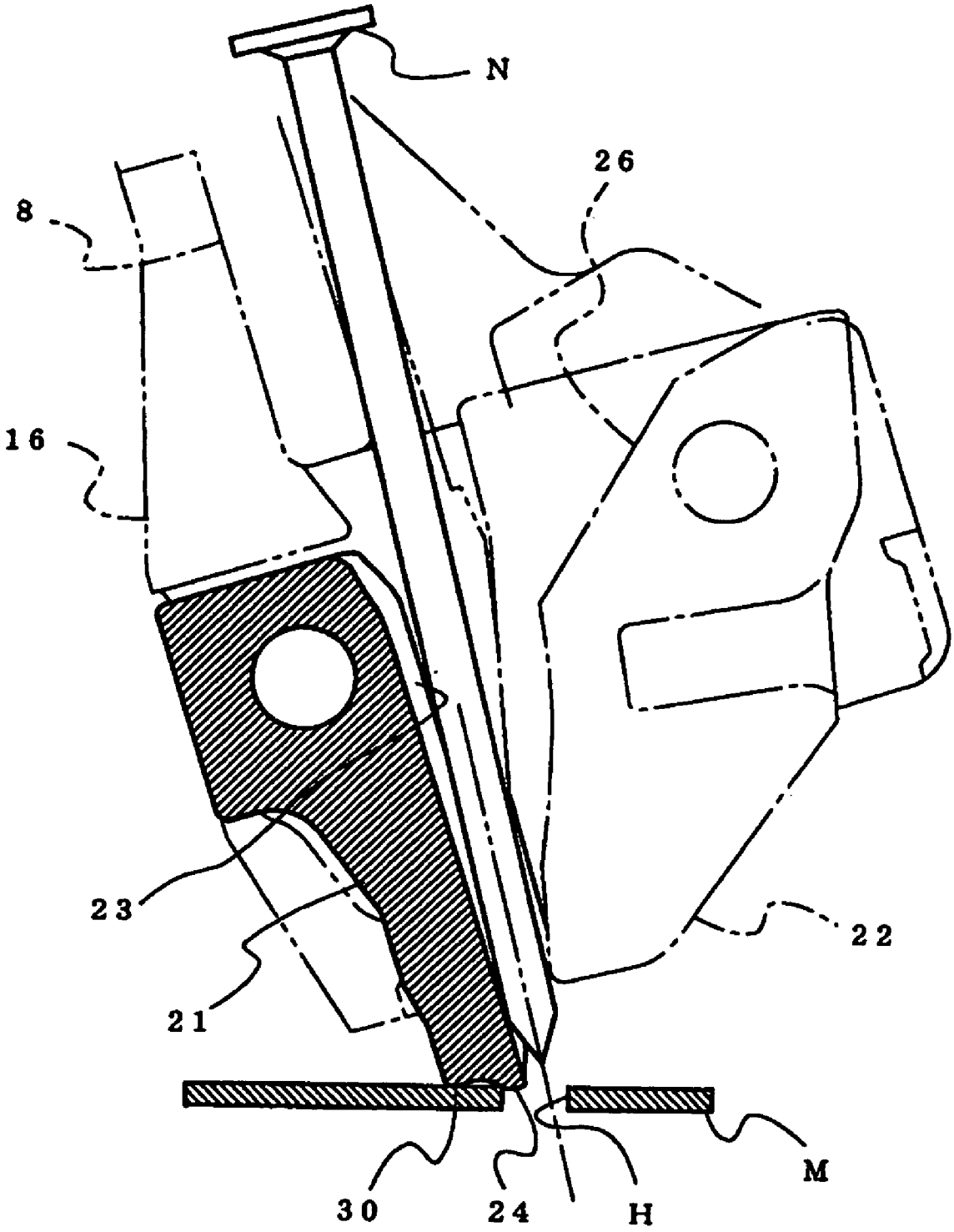
[FIG. 9]
Figure 10:
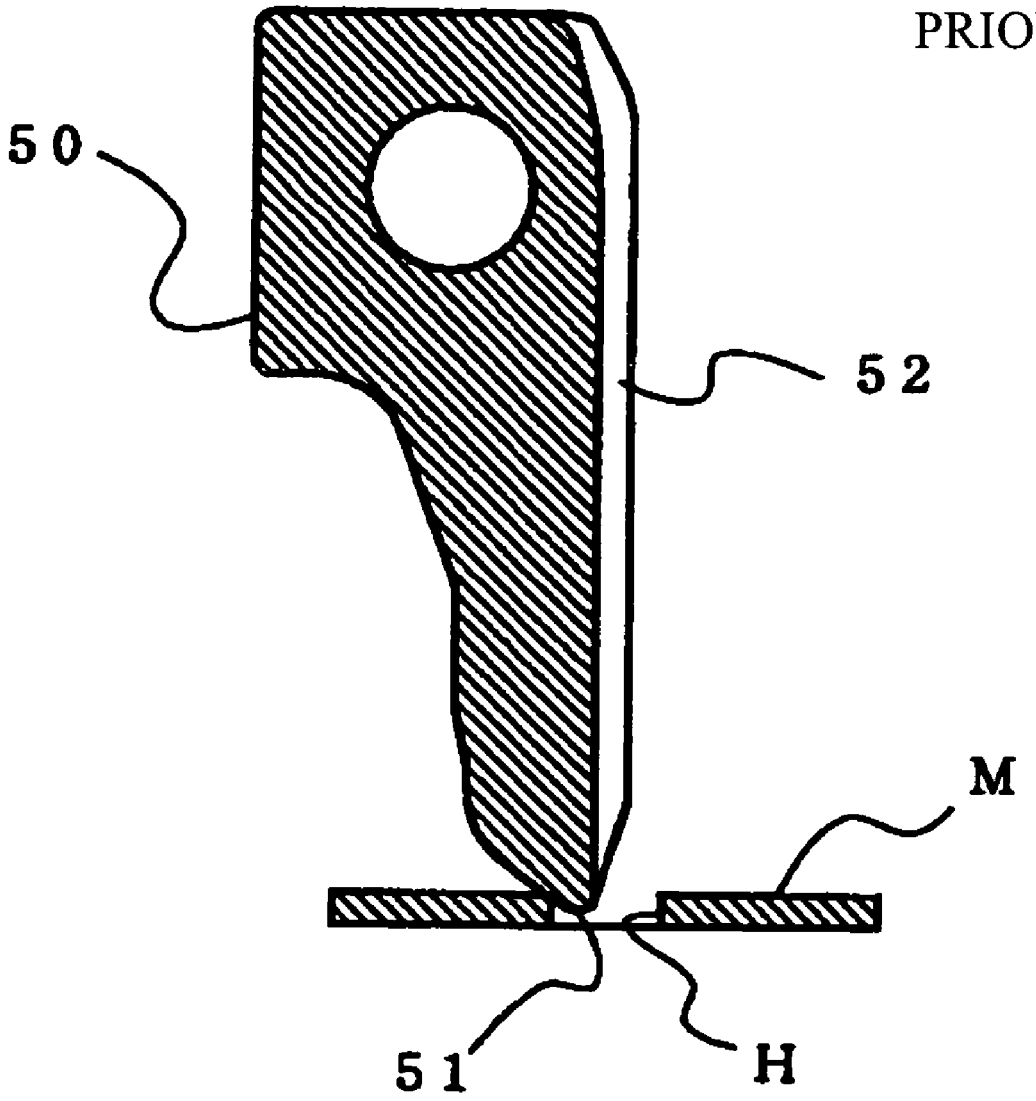
FIG. 10 PRIOR ART
[FIG. 10]
Figure 11:
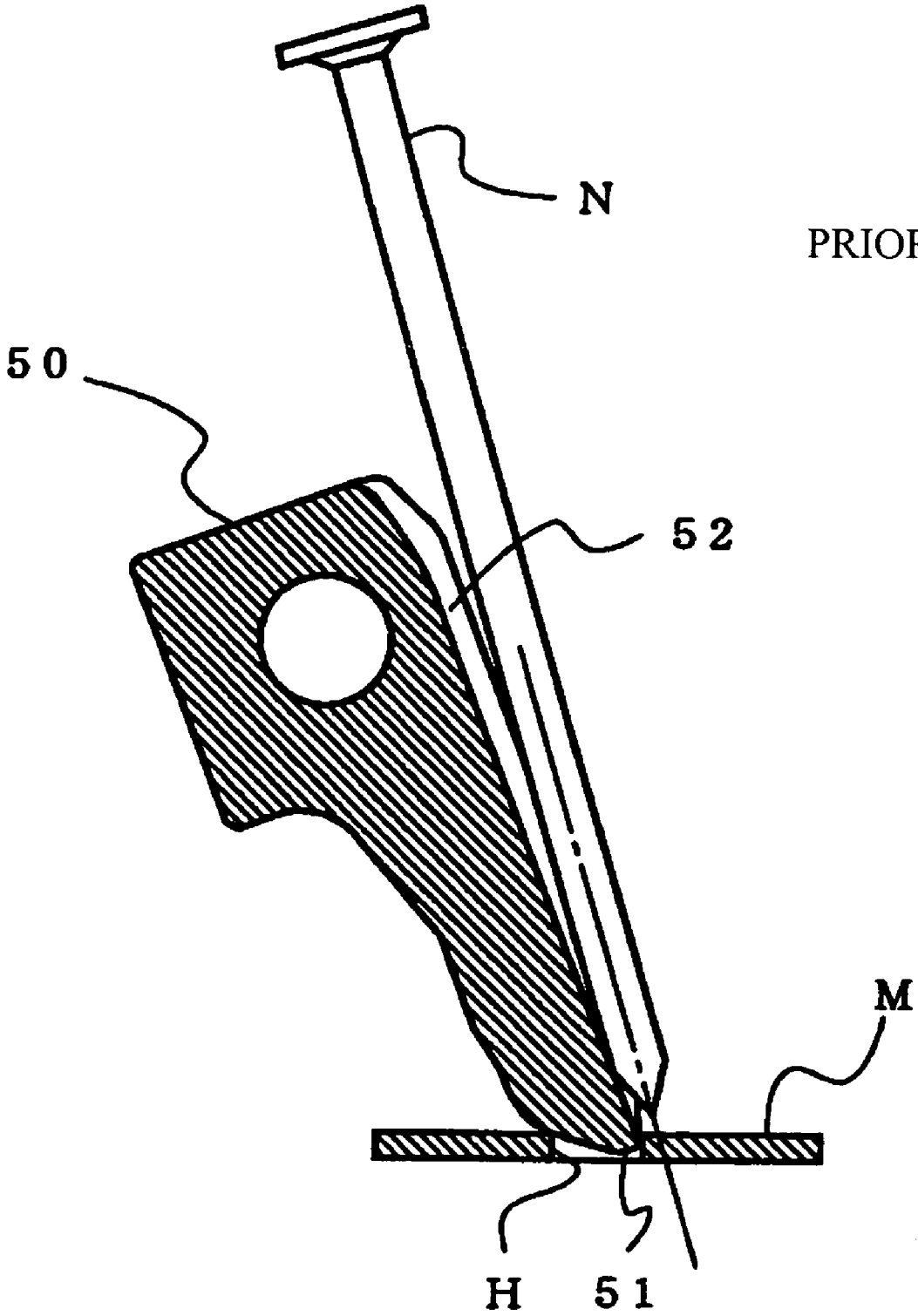
[FIG. 11]

When the nailing machine 1 is operated to press to the construction metal piece M after engaging the projected portion 24 of the nail guide member 21 into the nail hole H of the construction metal piece M, in a case in which the nailing machine is inclined to a front side as shown by FIG. 9, the bulged portion 30 formed on the upper side of the projected portion 24 of the nail guide member 21 is engaged with the surface of the construction metal piece M, and the nailing machine is inclined such that the nail guide member 21 is rotated by constituting a pivoting fulcrum of inclination by the bulged portion 30. By pivoting the nailing machine by engaging the bulged portion 30 formed on the upper side of the projected portion 24 of the nail guide member 21 with the surface of the construction metal piece M in this way, the projected portion 24 in the half cut converging taper shape of the nail guide member 21 is moved to a rear side of inside of the nail hole H of the construction metal piece M and the nail hole H is not closed. Further, as shown by FIG. 9, the front end of the nail struck to be guided by the guiding guide groove 23 of the inclined nail guide member 21 can be guided into the nail hole H, and the nail N can firmly be struck into the nail hole H of the construction metal piece M.

Further, although an explanation has been given by using the nail N in the above-described, the embodiment is not limited thereto but in place of the nail N, a pin member struck into concrete may be used. Further, a screw member formed with a screw ridge at a shaft portion may be used. Further, although a detailed description has been given by using the construction metal piece M as a fixed member, the embodiment is not limited thereto but in place of the construction metal piece M, a roof tile member or a tile-like member formed with a nail hole may be used. In sum, the embodiment is applicable widely to a technology of striking a striking member of a nail, a pin, a screw or the like to a struck member by way of an opening hole formed at a fixed member. Further, although in the above-described, an explanation has been given of a nailing machine operated by constituting a power source by compressed air, a nail machine for driving a driver by constituting a power source by a combustion gas may be used.

Although the invention has been explained in details and in reference to the specific embodiment, it is apparent for the skilled person that the invention can variously be changed or modified without departing from the spirit and the scope of the invention.

The application is based on Japanese Patent Application (Japanese Patent Application No. 2004-134306) filed on Apr. 28, 2004 and a content thereof is incorporated here by reference.

INDUSTRIAL APPLICABILITY

According to the nailing machine of the invention, the nail guide member for guiding the nail member struck by the driver includes the projected portion the outer diameter shape of which is formed in the half cut converging taper shape and which advances to the inner portion of the nail hole formed at the fixed piece member for positioning the nailing machine relative to the nail hole, the guiding guide groove formed to be able to guide the front end of the nail struck by the driver to the projected portion, and the bulged portion formed on the upper side of the projected portion and brought into contact with the surface of the fixed piece member, the bulged portion constitutes the fulcrum of inclination when the nailing machine is inclined to the front side and therefore, the front end of the nail member struck out from inside of the injection port of the nose portion is firmly guided into the nail hole formed at the fixed member.

The invention claimed is:

1. A nailing machine comprising:

a driver for striking a nail;

a nose portion for guiding the driver and including an injection port;

a contact member slidable along the nose portion; and a nail guide member arranged on the injection port and fixed so as not to be able to be pivoted or moved relative to the contact member;

wherein the nail guide member comprises:

a projected portion having an outer shape in a half cut converging taper shape;

a guiding guide groove provided at a rear side face of the nail guide member; and a bulged portion provided on an upper side of the projected portion, wherein a lower face of the bulged portion is brought into contact with a surface of a fixed piece member so that a position of the nose portion from the surface of the fixed piece member is maintained to be constant when the projected portion is inserted inside of a nail hole of the fixed piece member so as to position the nailing machine relative to the nail hole, wherein a length of the projected portion projected from the bulged portion along a direction of extending the nose portion is smaller than a thickness of the fixed piece member so that the projected portion is not brought into contact with a matrix member when the projected portion is inserted into the nail hole of the fixed piece member on the matrix member.

2. The nailing machine according to claim 1, wherein the guiding guide groove guides a front end of the nail struck by the driver to the projected portion; and when the nailing machine positioned to the nail hole is inclined to a front side, the bulged portion constitutes a fulcrum of inclination.

3. The nailing machine according to claim 1, wherein the guiding guide groove is arranged coaxially with the injection port.

4. The nailing machine according to claim 1, wherein the nail guide member is held at the contact member by a pin member.

5. The nailing machine according to claim 4, wherein a front end of the contact member is provided with side walls opposed to each other projected from a front end of the injection port;

the nail guide member is arranged such that at least the projected portion and the bulged portion are projected between the side walls; and one end side of the pin member is formed with a locking edge portion, and the other end side of the pin member is mounted with an elastic ring-like member.

6. The nailing machine according to claim 1, further comprising:

a ratchet member arranged on a rear side of the injection port and pivotably supported by the contact member.

7. The nailing machine according to claim 6, further comprising:

a spring for urging to pivot the ratchet member to the nail guide member.

8. The nailing machine according to claim 1, wherein an angle of a taper of the projected portion is larger than 45 degrees.

9. The nailing machine according to claim 1, wherein the length of the projected portion projected from the bulged portion along a direction of extending the nose portion is smaller than a thickness of the fixed piece member.

10. The nailing machine according to claim 1, wherein an angle of a taper of the projected portion is formed so as to enable the projected portion to escape from the nail hole when the nail is struck into the nail hole.

* * * * *